US005290651A

United States Patent [19]

Ong

[11] Patent Number: 5,290,651

[45] Date of Patent: Mar. 1, 1994

[54] TONER COMPOSITIONS WITH ZINC COMPLEX CHARGE ENHANCING ADDITIVES

[75] Inventor: Beng S. Ong, Mississauga, Canada

[73] Assignee: Xerox Corporation, Stamford, Conn.

[21] Appl. No.: 964,541

[22] Filed: Oct. 21, 1992

[51] Int. Cl.[5] ..... G03G 9/083

[52] U.S. Cl. ..... 430/106.6; 430/110

[58] Field of Search ..... 430/110, 106.6

[56] References Cited

U.S. PATENT DOCUMENTS 4,206,064 6/1980 Kiuchi et al. ..... 430/106

4,298,672 11/1981 Lu ..... 430/108

4,411,974 10/1983 Lu et al. ..... 430/106

4,845,003 7/1989 Kiriu et al. ..... 430/110

5,153,089 10/1992 Ong et al. ..... 430/110

*Primary Examiner*—Christopher Rodee

*Attorney, Agent, or Firm*—E. O. Palazzo

[57] ABSTRACT

A negatively charged toner composition comprised of a polymer resin or polymer resins, colorants comprised of pigment particles and/or dyes, optional surface additives, and a nonionic zinc complex charge enhancing additive containing two different ligands derived from an ortho-hydroxyphenol and an ortho-hydroxybenzoic acid.

24 Claims, No Drawings

TONER COMPOSITIONS WITH ZINC COMPLEX CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention toner compositions comprised of a polymer or polymer resins, color pigment particles or dye molecules, and certain zinc complex charge enhancing additives containing mixed ligands derived from ortho-hydroxybenzoic acid and ortho-hydroxyphenol. In embodiments, the present invention is directed to toners with certain zinc complex charge enhancing additives, which additives are obtained from the reaction of an ortho-hydroxybenzoic acid and a base with an aqueous zinc ion solution containing an ortho-hydroxyphenol. The zinc complex charge enhancing additives in embodiments are believed to be nonionic in nature and comprised of two different ligands, one ortho-hydroxybenzoic acid and one ortho-hydroxyphenol, chelating to the central zinc atom. The aforementioned charge additives in embodiments of the present invention enable, for example, toners with rapid triboelectric charging characteristics, extended developer life, stable triboelectrical properties irrespective of changes in environmental conditions, and high image print quality with substantially no background deposits. Also, the aforementioned toner compositions usually contain a colorant component comprised of, for example, carbon black, magnetites, or mixtures thereof, color pigments or dyes with cyan, magenta, yellow, blue, green, red, or brown color, or mixtures thereof thereby providing for the development and generation of black and/or colored images. The toner and developer compositions of the present invention can be selected for electrophotographic, especially xerographic, imaging and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003 there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A fast rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another shortcoming of these charge additives is their thermal instability, that is they often break down during the thermal extrusion process of the toner manufacturing cycle. Most or many of these and other disadvantages are eliminated, or substantially eliminated with the zinc complex charge additives of the present invention.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, discloses developer compositions containing as charge enhancing additives organic sulfate and sulfonates, which additives can impart a positive charge to the toner composition; U.S. Pat. No. 4,298,672, the disclosure of which is totally incorporated herein by reference, discloses positively charged toner compositions with resins and pigment particles, and as charge enhancing additives alkyl pyridinium compounds.

Disclosed in copending patent applications U.S. Ser. No. 894,688 and U.S. Ser. No. 894,690 are toner and developer compositions containing metal complex charge additives which are anionic in nature, the disclosures of which are totally incorporated herein by reference. More specifically, disclosed in these copending patent applications is a negatively charged toner composition comprised of a polymer or polymer resins, a colorant or colorants, optional surface additives, and a metal complex charge enhancing additive obtained from the reaction of a hydroxybenzoic acid and a base with a mixture of a metal ion and a hydroxyphenol; and a negatively charged toner composition comprised of a polymer or polymers, a colorant or colorants, optional surface additives, and a metal complex charge enhancing additive obtained from the reaction of a hydroxybenzoic acid and a base with a mixture of a metal ion and an aromatic dicarboxylic acid. These complexes are comprised of an anion with two bidentate ligands chelating to a central metal, and countercations of protons, alkaline metal ions, ammonium ions, and the like.

Although many charge enhancing additives are known, there continues to be a need for charge enhancing additives which, when incorporated in toners, provide toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of, for example, from between about −10 to about −40 microcoulombs per gram, and preferably from about −10 to about −25 microcoulombs per gram, and triboelectric charging rates of less about 120 seconds, and preferably less than 60 seconds as measured by standard charge spectrograph methods when the toners are frictionally charged against suitable carrier particles via conventional roll milling techniques. There is also a need for environmentally compatible charge enhancing additives which when incorporated at effective concentrations of, for example, less than 10 weight percent, preferably less than 5 weight percent in toners, provide toners that are environmentally acceptable. An additional need resides in the provision of simple and cost-effective preparative processes for the zinc complex charge enhancing additives of the present invention. The concentrations of the charge additives that can be incorporated into the toner compositions generally range from about 0.05 weight percent to about 10 weight percent, depending on whether the charge additive is utilized as a surface additive or as a dispersion in the bulk of the toner. The effective concentrations of toner in the developer, that is toner and carrier particles, are, for example, from about 0.5 to about 5 weight percent, preferably from about 1 to about 3 weight percent.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

In yet a further object of the present invention there may be provided, it is believed, humidity insensitive, from about, for example, 20 to 80 percent relative humidity at temperatures of from 60° to 80° F. as determined in a relative humidity testing chamber, negatively charged toner compositions with desirable triboelectric charging rates of less than 120 seconds, and preferably less than 60 seconds as determined by the charge spectrograph method, and acceptable triboelectric charging levels of from about −10 to about −40 microcoulombs per gram.

Another object of the present invention resides in the preparation of negative toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is for example those exceeding 50 copies per minute.

A further object is to provide a simple and cost-effective process for the preparation of zinc complex charge enhancing additives.

These and other objects of the present invention may be accomplished in embodiments thereof by providing toner compositions comprised of a polymer resin or polymer resins, colorants comprised of color pigment particles or dye molecules, and certain zinc complex charge enhancing additives derived from the reaction of an ortho-hydroxybenzoic acid and a base with an aqueous zinc ion solution containing an ortho-hydroxyphenol. More specifically, the present invention in embodiments is directed to toner compositions comprised of polymer resins, pigment, or dye, and a negative charge enhancing additive which may be represented by the formulas (I) and (II)

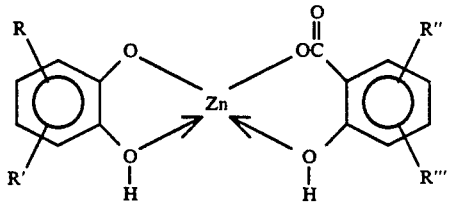

(I)

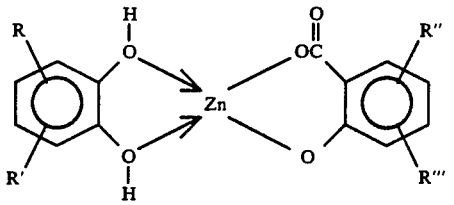

(II)

wherein R, R', R'', and R''' are independently selected from the group consisting of hydrogen, alkyl with, for example, 1 to about 10 carbon atoms, aryl with, for example, from 6 to about 24 carbon atoms such as phenyl, tolyl, and the like, alkoxy and aryloxy with from 1 to about 12 carbon atoms, halogen like chlorine, bromine, amino, hydroxy, and the like. Examples of alkyl, and alkoxy include known components with, for example, 1 to about 10 carbon atoms, such as methyl, methoxy, ethyl, ethoxy, propyl, propoxy, butyl, butoxy, pentyl, pentoxy, hexyl, hexoxy, heptyl, heptoxy, and the like. Aryl and aryloxy include known substituents such as phenyl, phenoxy, tolyl, methylphenoxy, naphthyl, naphthoxy, and the like. Halogen includes chlorine, bromine, iodine, and fluorine.

The aforementioned charge additives can be incorporated into the toner, may be present on the toner surface, or may be present on toner surface additives such as colloidal silica particles. Advantages of rapid triboelectric charging characteristics of generally less than 120 seconds, and preferably less than 60 seconds in embodiments as measured by the standard charge spectrograph methods when the toner particles are frictionally charged against carrier particles by known conventional roll mixing methods, appropriate triboelectric charge levels, and the like can be achieved with many of the aforementioned toners of the present invention. In another embodiment of the present invention, there are provided, subsequent to known micronization and classification, toner particles with a volume average diameter of from about 2 to about 20 microns.

The zinc complex charge additives of the present invention can be prepared by the reaction of an ortho-hydroxybenzoic acid and a base with an aqueous zinc ion solution containing an ortho-hydroxyphenol. Specifically, the synthesis can be accomplished by a dropwise addition of an aqueous solution of one molar equivalent of an ortho-hydroxybenzoic acid and two or more molar equivalents of a base to a well stirred aqueous zinc sulfate solution containing slight excess of an ortho-hydroxyphenol. The addition is carried out over a period of from about 15 minutes to 2 hours, and the zinc sulfate solution is retained at a temperature ranging from ambient to about 90° C. After the addition, the reaction mixture is stirred at a temperature of from about 40° C. to the refluxing temperature of the reaction medium for another period of 15 minutes to several hours, for example about 10 hours. The reaction product is then filtered, and washed with dilute aqueous base, water, and then dried in a vacuum.

The toner compositions of the present invention can be prepared by a number of known methods such as admixing and heating polymer resins such as styrene butadiene copolymers, colorants such as color pigment particles or dye compounds, and the aforementioned metal complex charge enhancing additive, or mixtures of charge additives in a concentration preferably ranging from about 0.5 percent to about 5 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 2 to about 25 microns, and preferably from about 3 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; styrene acrylates, styrene methacrylates, styrene butadienes; epoxy polymers; polyurethanes; polyamides and polyimides; polyesters; and the like. The polymer resins selected for the toner compositions of the present invention include homopolymers or copolymers of two or more monomers. Furthermore, the above mentioned polymer resins may also be crosslinked depending on the desired toner properties. Illustrative vinyl monomer units in the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, cyclopentanediols, bis(hydroxyphenyl)alkanes, dihydroxybiphenyl, substituted dihydroxybiphenyls, and the like.

In embodiments, there are selected polyester resins derived from a dicarboxylic acid and a diphenol, reference U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further low melting polyesters, especially those prepared by reactive extrusion, reference U.S. Ser. No. 814,641, and U.S. Ser. No. 814,782, the disclosures of which are totally incorporated herein by reference, can be selected as toner resins. Other specific toner resins include styrene-methacrylate copolymers and styrene-butadiene copolymers; PLIOLITES ®; suspension polymerized styrene-butadienes, reference U.S. Pat. No. 4,558,108, the disclosure of which is totally incorporated herein by reference. Also, waxes with a molecular weight of from about 1,000 to about 6,000, such as polyethylene, polypropylene, and paraffin waxes, can be included in, or on the toner compositions as fuser roll release agents.

The toner resins are present in a sufficient, but effective amount, for example from about 30 to about 95 weight percent. Thus, when 1 percent by weight of the charge enhancing additive is present, and 10 percent by weight of colorant, such as carbon black or color pigment, is contained therein, about 89 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black, like REGAL 330 ®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK ®, they are present in the toner composition in an amount of from about 5 weight percent to about 60 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK ®, in an amount of, for example, from about 5 to about 60, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL ®, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL ®, can be surface treated with the metal complex charge additives of the present invention illustrated herein in an amount of from about 1 to about 50 weight percent and preferably 10 weight percent to about 25 weight percent, followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15R TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, optional surface additives, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta colorants that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan colorants that may be used include copper phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow colorants that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 to about 1,000 microns, and preferably from between about 80 and 200 microns in volume average diameter thereby permitting them, for example, to possess sufficient density and inertia to avoid adherence to the electrostatic images during the development process. The carrier component can be mixed with the toner composition in various suitable combinations, such as about 1 to about 5 parts of toner by weight per 100 parts by weight of carrier.

The toner composition of the present invention can be prepared by a number of known methods including extrusion melt blending the toner resins, colorants, and the metal complex charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive treated surface additives such as colloidal silicas. Further, other methods of preparation for the toner are as illustrated herein.

The toner and developer compositions of the present invention may be selected for use in electrostatographic imaging apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 2 to about 25 microns, and more preferably from about 3 to about 12 microns. The triboelectric charging rates for the toners of the present invention are preferably less than 120 seconds, and more specifically, less than 60 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

Examples of specific charge additives of the present invention are as illustrated herein and include (4-tert-butylcatecholato-3,5-di-tert-butylsalicylato)zinc, (4-methylcatecholato-3,5-di-tert-butylsalicylato)zinc, (catecholato-3,5-di-tert-butylsalicylato)zinc, (4-tert-butylcatecholato-4-hydroxysalicylato)zinc, (4-tert-butylcatecholato-3,5-diisopropylsalicylato)zinc, (4-tert-butylcatecholato-5-iodosalicylato)zinc, (4-tert-butylcatecholato-5-bromosalicylato)zinc, (4-tert-butyl-catecholato-4-methylsalicylato)zinc, (4-tert-butyl-catecholato-3-methylsalicylato)zinc, (4-tert-butyl-catecholato-3-methoxysalicylato)zinc, and (4-tert-butylcatecholato-3,5-diiodosalicylato)zinc.

The following Examples are being supplied to further illustrate various embodiments of the present invention, it being noted that these Examples are intended to illustrate and not limit the scope of the present invention. Comparative Examples are also presented.

EXAMPLE I

The zinc charge enchancing additive, (4-tert-butylcatecholato-3,5-di-tert-butylsalicylato)zinc, was prepared according to the following procedure.

A mixture of 7.19 grams (25.0 millimoles) of zinc sulfate heptahydrate [$ZnSO_4.7H_2O$] and 4.99 grams (30.0 millimoles) of 4-tert-butylcatechol in 100 milliliters of water was mechanically stirred and heated to 85° to 90° C. in a 1 liter round-bottomed flask fitted with a water condenser. To this reaction mixture was added in a dropwise fashion a solution of 3.30 grams of potassium hydroxide and 6.26 grams (25.0 millimoles) of 3,5-di-tert-butylsalicylic acid in 150 milliliters of water. The addition was accomplished at a rate of about 2 milliliters per minute over a period of about 75 minutes, and a grayish white product was observed to precipitate out of solution throughout the addition. Subsequently, the reaction mixture was further stirred at the same temperature for another 2 hours, and then cooled down to about 50° to 60° C. before it was filtered. The grayish zinc complex product was first washed with dilute aqueous potassium hydroxide solution and then water, and was dried in vacuo at 75° C. for 36 hours. The yield was 91 percent.

$^1$H-NMR (DMSO-$d_6$/TFA-d), δ(ppm): 1.16 (s, 9H); 1.22 (s, 9H); 1.34 (s, 9H); 6.5 to 6.8 (ABC, 3H); 7.4 to 7.7 (AB, 2H).

Elemental Analysis Calculated for: $C_{25}H_{34}O_5Zn$: C, 62.57; H, 7.14; O, 16.67; Zn, 13.62. Found: C, 61.93; H, 6.85; O, 16.34; Zn, 12.79.

EXAMPLE II

The zinc charge enhancing additive, (4-methylcatecholato-3,5-di-tert-butylsalicylato)zinc, was prepared in accordance with the procedure of Example I except that 4-methylcatechol was utilized in place of 4-tert-butylcatechol. The yield of (4-methylcatecholato-3,5-di-tert-butylsalicylato)zinc was 87 percent.

EXAMPLE III

The zinc charge enhancing additive, (4-tert-butylcatecholato-3,5-di-iodosalicylato)zinc, was prepared in accordance with the procedure of Example I except that 3,5-diiodosalicylic acid was utilized in place of 3,5-di-tert-butylsalicylic acid. The yield of (4-tert-butylcatecholato-3,5-diiodosalicylato)zinc was 92 percent.

EXAMPLE IV

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference and 6.0 weight percent REGAL 330® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classifed in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface coated with 0.25 weight percent of (4-tert-butylcatecholato-3,5-di-tert-butylsalicylato)zinc of Example I by blending in a small coffee mill for 30 to 60 seconds.

The above treated toner was equilibrated at room temperature under a 50 percent relative humidity condition for 24 hours. A developer was then prepared by blending 2.0 weight percent of the surface treated toner with 98.0 weight percent of a carrier containing a nickel zinc ferrite core obtained from Steward Chemicals and 0.9 weight percent of a polymer composite coating comprised of 80 weight percent of a methyl terpolymer and 20 weight percent of VULCAN XC72R ® carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be -28.6 microcoulombs per gram by the standard blow-off technique in a Faraday Cage apparatus. To measure the rate of triboelectric charging of toner, 1.0 weight percent of the uncharged toner was added to the time zero developer, and the charge distribution of the toner of the resulting developer was measured as a function of the blending time via roll milling using a charge spectrograph. The time required for the toner of the resulting developer to attain a charge distribution similar to that of the toner of the time zero developer was taken to be the rate of charging of the toner. For this toner, the rate of charging was about 15 seconds.

COMPARATIVE EXAMPLE (A)

A comparative black toner with a commercial charge enhancing additive, BONTRON E-88 TM (obtained from Orient Chemicals), which is believed to be an anionic complex of an anion of two 3,5-di-tert-butylsalicylic acid ligands bonded to a central aluminum atom, and a countercation of proton or alkaline metal ion was prepared by blending the untreated toner of Example IV with 0.25 weight percent of BONTRON E-88 TM, and a developer was then prepared from this toner in accordance with the procedure of Example IV. The toner exhibited a triboelectric charge of −40.4 microcoulombs per gram, and its rate of charging was measured to be about 5 minutes.

EXAMPLE V

A black toner with (4-methylcatecholato-3,5-di-tert-butylsalicylato)zinc of Example II as a charge enhancing additive was prepared in accordance with the procedure of Example IV except that 0.10 weight percent of (4-methylcatecholato-3,5-di-tert-butylsalicylato)zinc was employed in place of 0.25 weight percent of (4-tert-butylcatecholato-3,5-di-tert-butylsalicylato)zinc as the charge enhancing additive, and a developer was then prepared from this toner as before. The toner has a triboelectric charge of −20.9 microcoulombs per gram, and a charging rate of about 15 seconds.

COMPARATIVE EXAMPLE (B)

A comparative black toner with 0.10 weight percent of the commercial charge enhancing additive, BONTRON E-88 TM obtained from Orient Chemicals, was prepared by blending the untreated toner of Example IV with 0.10 weight percent of BONTRON E-88 TM, and a developer was then prepared from this toner in accordance with the procedure of Example IV. The toner exhibited a triboelectric charge level of −15.2 microcoulombs per gram, and its rate of charging was measured to be about 5 minutes.

EXAMPLE VI

A black toner with 0.25 weight percent of (4-tert-butylcatecholato-3,5-diiodosalicylato)zinc of Example III as a charge enhancing additive was prepared in accordance with the procedure of Example IV except that (4-tert-butylcatecholato-3,5-diiodosalicylato)zinc was utilized instead of (4-tert-butylcatecholato-3,5-di-tert-butylsalicylato)zinc. A developer was then prepared from this toner in accordance with the procedure of Example IV. The toner displayed a triboelectric charge of −31.2 microcoulombs per gram, and its rate of charging was measured to be about 15 seconds.

COMPARATIVE EXAMPLE (C)

A comparative black toner with 0.25 weight percent of the commercial charge enhancing additive, BONTRON E-84 TM (obtained from Orient Chemicals), which is believed to be comprised of an anion of two 3,5-di-tert-butylsalicylic acid ligands bonded to a central zinc atom, and a countercation of proton or alkaline metal ion, was prepared by blending the untreated toner of Example IV with 0.25 weight percent of BONTRON E-84 TM, and a developer was then prepared from this toner in accordance with the procedure of Example IV. The toner exhibited a triboelectric charge of −25.6 microcoulombs per gram, and its rate of charging was measured to be about 10 minutes.

EXAMPLE VII

A blue toner comprised of 97.0 weight percent of SPAR II polyester resin, 2.0 weight percent of PV FAST BLUE TM pigment, and 1.0 weight percent of (4-tert-butylcatecholato-3,5-di-tert-butylsalicylato)zinc of Example I was prepared by melt blending these three components, followed by micronizing and classifying in accordance with the procedure of Example IV. The resulting toner had a volume average particle diameter of 8.9 microns, and a particle size distribution of 1.29. A developer was prepared from this toner using 2.0 weight percent of toner and a carrier containing a steel core and 0.8 weight percent of a polymer composite coating comprised of 80 weight percent of polymethyl methacrylate and 20 weight percent of VULCAN XC72 TM carbon black. The toner displayed a triboelectric charge of −16.7 microcoulombs per gram, and its rate of charging was measured to be about 60 seconds.

The toner was then surface coated with 0.5 weight percent of AEROSIL R972 ® by a conventional dry blending method, and a developer was made from this toner and the same carrier particles as before. The triboelectric charge of this toner was measured to be −19.2 microcoulombs per gram, and its rate of charging was 30 seconds.

COMPARATIVE EXAMPLE (D)

A comparative blue toner and developer composition with a commercial charge additive, BONTRON E-84 TM, were prepared in accordance with the procedure of Example VII except that BONTRON E-84 TM was utilized in place of the zinc complex charge additive of Example I. The toner displayed a triboelectric charge of −10.5 microcoulombs per gram, and its rate of charging was about 15 minute.

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of a polymer resin or polymer resins, colorants comprised of pigment particles and/or dyes, optional surface additives, and a nonionic zinc complex charge enhancing additive containing two different ligands derived from an ortho-hydroxyphenol and an ortho-hydroxybenzoic acid.

2. A toner composition in accordance with claim 1 wherein the charge additive is present in an amount of from about 0.05 to about 10 weight percent.

3. A toner composition in accordance with claim 1 wherein the charge additive is present in an amount of from about 0.05 to about 3 weight percent.

4. A toner composition in accordance with claim 1 wherein the polymer is selected from the group consisting of styrene polymers, styrene acrylic polymers, styrene methacrylic polymers, polyesters, and mixtures thereof.

5. A toner composition in accordance with claim 1 wherein the colorants are carbon black, magnetites, or mixtures thereof, cyan, magenta, yellow, red, blue, green, brown pigments, or mixtures thereof.

6. A negatively charged toner composition comprised of polymer, pigment, optional surface additives, and a zinc complex charge enhancing additive represented by either of the two following formulas

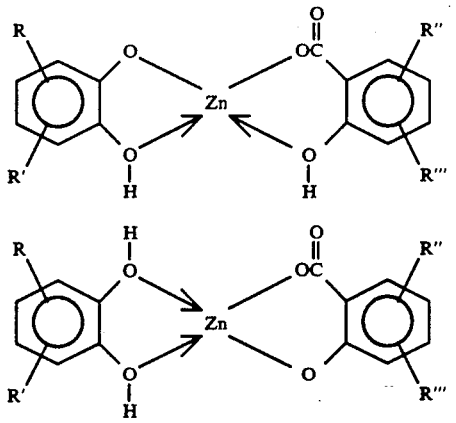

wherein R, R', R'', and R''' are independently selected from the group consisting of hydrogen, alkyl, aryl, alkoxy, aryloxy, halogen, amino, and hydroxy.

7. A toner composition in accordance with claim 6, wherein the charge additive is selected from the group consisting of (4-tert-butylcatecholato-3,5-di-tert-butylsalicylato)zinc, (4-methylcatecholato-3,5-di-tert-butylsalicylato)zinc, (catecholato-3,5-di-tert-butylsalicylato)zinc, (4-tert-butylcatecholato-4-hydroxysalicylato)zinc, (4-tert-butylcatecholato-3,5-diisopropylsalicylato)zinc, (4-tert-butylcatecholato-5-iodosalicylato)zinc, (4-tert-butyl-catecholato-5-bromosalicylato)zinc, (4-tert-butyl-catecholato-4-methylsalicylato)zinc, (4-tert-butyl-catecholato-3-methylsalicylato)zinc, (4-tert-butyl-catecholato-3-methoxysalicylato)zinc, and (4-tert-butyl-catecholato-3,5-diiodosalicylato)zinc.

8. A toner composition in accordance with claim 7 wherein the charge additive is present in an amount of from about 0.05 to about 10 weight percent.

9. A toner composition in accordance with claim 7 wherein the toner polymer is comprised of styrene polymers, acrylic or methacrylic polymers, polyesters, or mixtures thereof.

10. A toner composition in accordance with claim 7 wherein styrene polymers or polyesters are selected as the toner polymer.

11. A toner composition in accordance with claim 6 wherein R, R', R'', and R''' are selected from the group consisting of hydrogen, methyl, methoxy, tertiary-butyl, bromine, and iodine.

12. A toner composition in accordance with claim 6 wherein (tert-butylcatecholato-di-tert-butylsalicylato)-zinc, or (tert-butyl-catecholato-diiodosalicylato)zinc, or (tert-butyl-catecholato-methoxysalicylato)zinc are selected as the charge enhancing additive.

13. A toner composition in accordance with claim 6 with a negative triboelectric charge of from between about −10 to about −40 microcoulombs per gram.

14. (Amended) A toner composition in accordance with claim 6 wherein the polymer is selected from the group consisting of styrene acrylates, styrene methacrylates, and styrene butadienes.

15. A toner composition in accordance with claim 6 containing a wax component which has a weight average molecular weight of from about 1,000 to about 7,000.

16. A toner composition in accordance with claim 15 wherein the wax component is selected from the group consisting of polyethylene and polypropylene.

17. A toner composition in accordance with claim 2 wherein the surface additives are metal salts of a fatty acid, colloidal silicas, or mixtures thereof.

18. A toner composition in accordance with claim 6 wherein the pigment is carbon black, magnetites, or mixtures thereof, cyan, magenta, yellow, red, blue, green, brown pigments, or mixtures thereof.

19. A toner in accordance with claim 6 wherein halogen is chlorine, bromine, or iodine; alkyl and alkoxy contain from 1 to about 10 carbon atoms; and aryl contains from 6 to about 24 carbon atoms.

20. A toner in accordance with claim 2 wherein aryl is phenyl or tolyl.

21. A developer composition comprised of a negatively charged toner composition comprised of a polymer resin or polymer resins, colorants comprised of pigment particles and/or dyes, optional surface additives, and a nonionic zinc complex charge enhancing additive containing two different ligands derived from an ortho-hydroxphenol and an ortho-hydroxybenzoic acid; and carrier particles.

22. A developer composition comprised of a negatively charged toner composition comprised of polymer, pigment, optional surface additives, and a zinc complex charge enhancing additive represented by either of the two following formulas

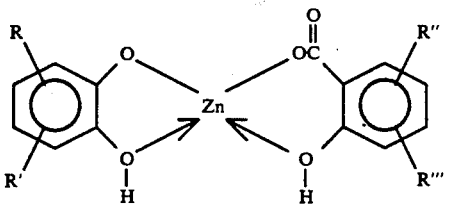

-continued

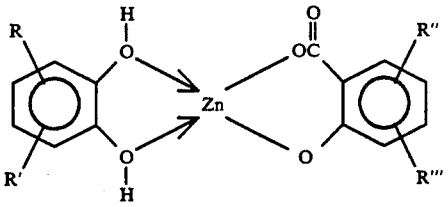

wherein R, R', R'', and R''' are independently selected from the group consisting of hydrogen, alkyl, aryl, alkoxy, aryloxy, halogen, amino, and hydroxy; and carrier particles.

23. A developer composition in accordance with claim 22 wherein the carrier particles are selected from the group consisting of ferrites, steel, and an iron powder with a polymer or mixture of polymers coating thereover.

24. A developer composition in accordance with claim 23 wherein the coating is selected from the group consisting of a methyl terpolymer, a polyvinylidine fluoride, a polymethyl methacrylate, and a mixture of polymers not in close proximity in the triboelectric series.

* * * * *